US007828621B2

(12) United States Patent
Lemaitre

(10) Patent No.: US 7,828,621 B2
(45) Date of Patent: Nov. 9, 2010

(54) APPARATUS AND METHODS FOR PRODUCING MULTI-ELECTRODE CATHODE FOR X-RAY TUBE

(75) Inventor: Sergio Lemaitre, Whitefish Bay, WI (US)

(73) Assignee: General Electric Company, Schenectady, NY (US)

( * ) Notice: Subject to any disclaimer, the term of this patent is extended or adjusted under 35 U.S.C. 154(b) by 959 days.

(21) Appl. No.: 11/278,398

(22) Filed: Mar. 31, 2006

(65) Prior Publication Data

US 2007/0232183 A1 Oct. 4, 2007

(51) Int. Cl.
*H01J 9/04* (2006.01)

(52) U.S. Cl. ..... 445/50

(58) Field of Classification Search ..... 445/46, 445/49, 50

See application file for complete search history.

(56) References Cited

U.S. PATENT DOCUMENTS

| | | | | |
|---|---|---|---|---|
| 3,412,917 | A * | 11/1968 | Omley | 228/44.3 |
| 4,628,573 | A * | 12/1986 | Hamada et al. | 29/25.35 |
| 4,663,189 | A * | 5/1987 | Borland | 427/79 |
| 4,995,914 | A * | 2/1991 | Teter | 134/21 |
| 5,458,856 | A * | 10/1995 | Marie et al. | 422/186 |
| 6,436,233 | B1 * | 8/2002 | Barrett et al. | 162/52 |
| 6,762,540 | B2 * | 7/2004 | Schaefer et al. | 313/302 |
| 6,811,938 | B2 * | 11/2004 | Tutt et al. | 430/22 |
| 2002/0017376 | A1 * | 2/2002 | Geltser et al. | 164/495 |
| 2004/0139598 | A1 * | 7/2004 | Berryman | 29/831 |

* cited by examiner

*Primary Examiner*—Joseph L Williams
*Assistant Examiner*—Hana S Featherly
(74) *Attorney, Agent, or Firm*—William Baxter, Esq.; Michael G. Smith, Esq.

(57) ABSTRACT

Apparatus and methods are provided through which a multi-electrode cathode assembly can be manufactured comprising bonding a monolithic metal block to the nonconductive base; and thereafter machining the block to form at least one electrode.

20 Claims, 7 Drawing Sheets

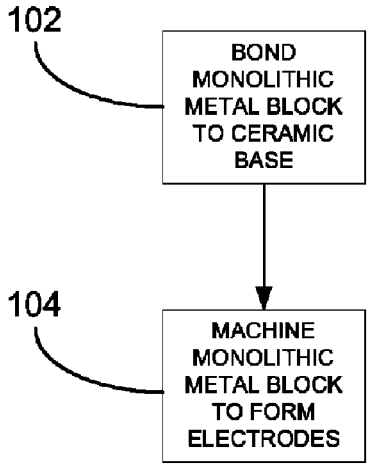
FIG. 1
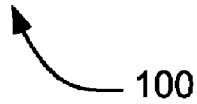

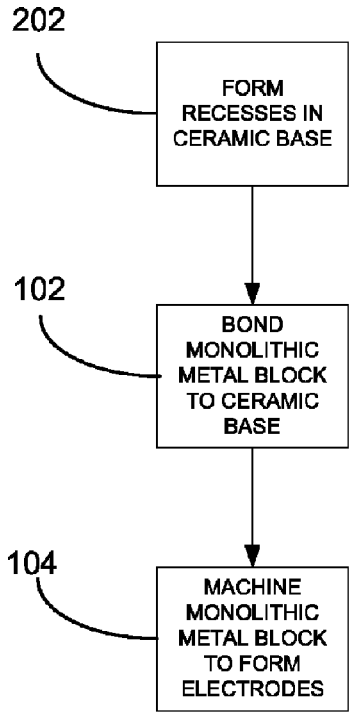
FIG. 2
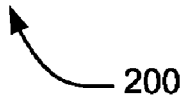

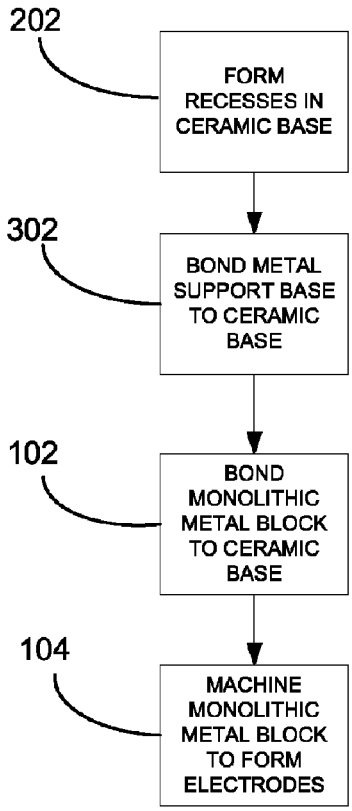
FIG. 3
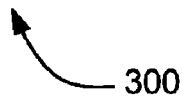

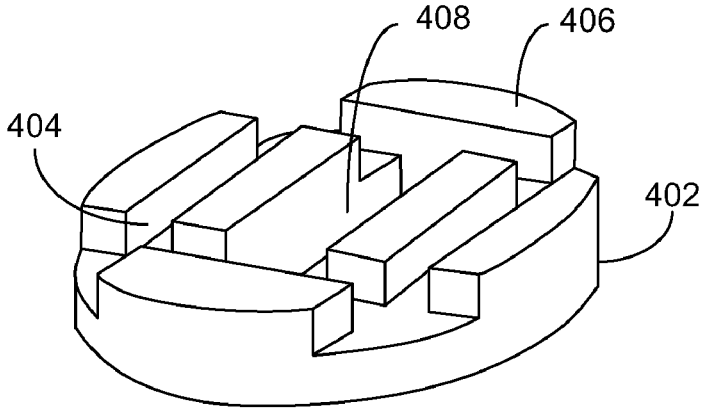
FIG. 4
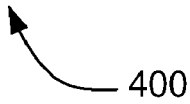

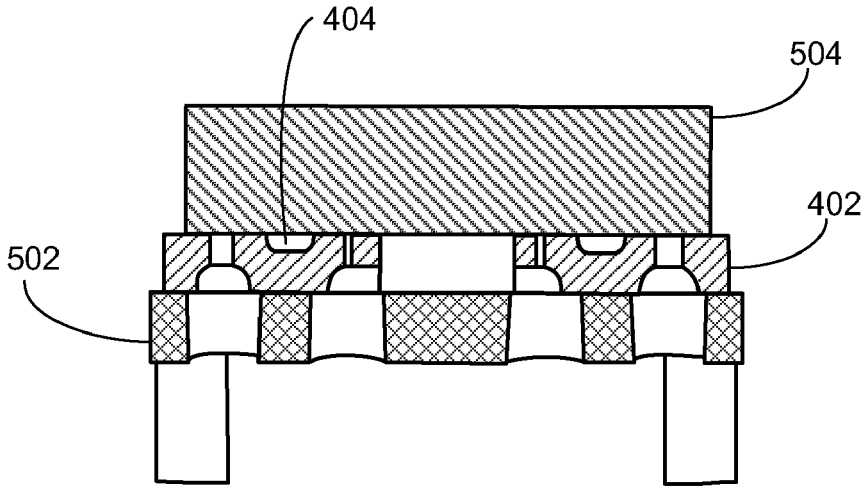
FIG. 5
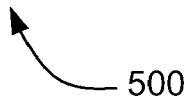

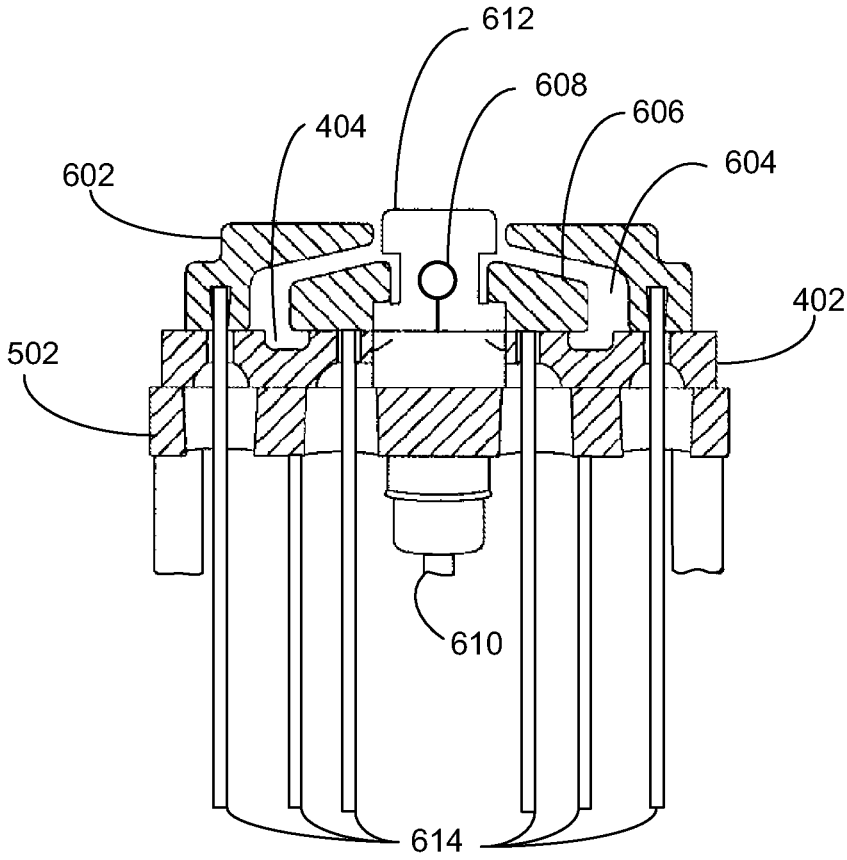
FIG. 6
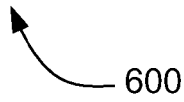

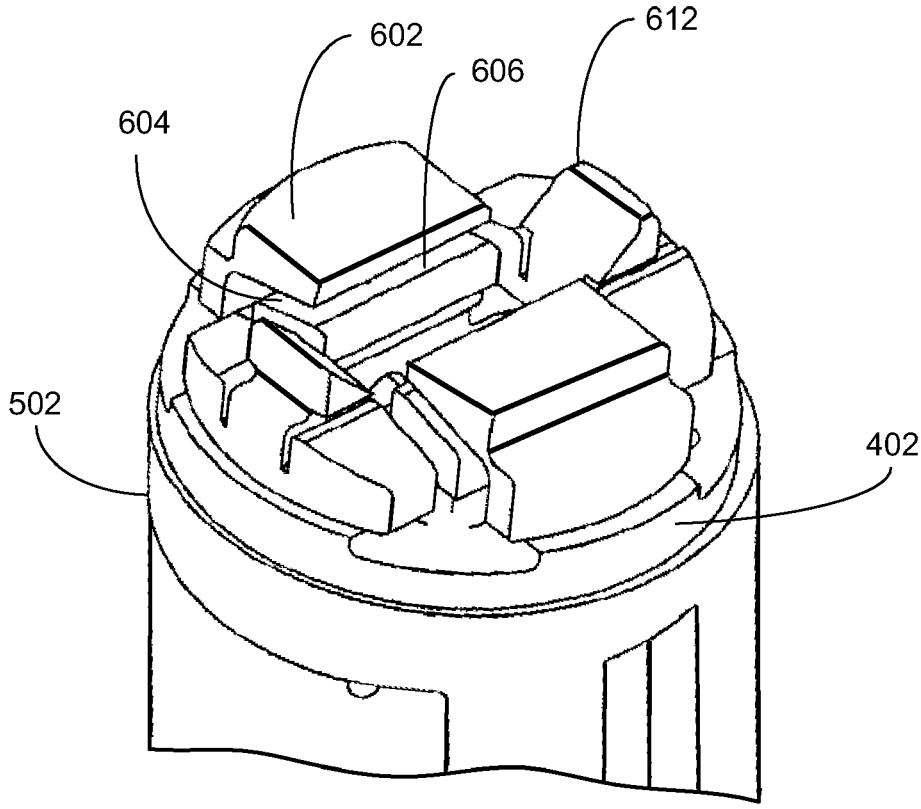
FIG. 7
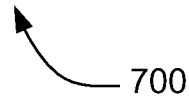

APPARATUS AND METHODS FOR PRODUCING MULTI-ELECTRODE CATHODE FOR X-RAY TUBE

FIELD OF THE INVENTION

This invention relates generally to X-ray tubes, and more particularly to multi-electrode cathode X-ray tubes that allow for focal spot control and methods for manufacturing them.

BACKGROUND OF THE INVENTION

X-ray tubes typically consist of a cathode assembly opposing an anode assembly contained within a vacuum tube. The basic cathode assembly is a filament that is recessed in a cup-shaped structure. When energized by a filament power supply, the cathode's filament heats up to extremely high temperatures and electrons are boiled off. The anode, which is typically tungsten, is located at the opposite side of the X-ray tube and is oppositely charged from the cathode. The positively charged anode attracts the negatively charged electrons expelled from the cathode. The electrons are accelerated towards the anode at great speed and collide with the anode with great force. The interaction between the colliding electrons and the tungsten atoms in the anode create high energy X-ray photons which can be used to perform noninvasive internal examinations because of their ability to pass through objects.

The X-ray radiation is produced in a small area on the surface of the anode called the focal spot. The size of the focal spot is determined by the size of the electron beam at the anode and is an important characteristic of the X-ray tube. The size of the focal spot essentially determines the resolution that can be obtained with any given X-ray tube. Small focal spot sizes produce less image blurring and is critical for higher resolution images in devices such as CT scanners. While small focal spot sizes provide for greater resolution, they also produce more heat in the assembly because the electron beam is concentrated in a small area on the anode. This high heat can damage the device unless mitigation techniques are utilized to reduce the heat before damage to the anode occurs.

Oversampling is a technique that is used to obtain higher resolutions in CT scanners using digital detectors while reducing anode heating. To achieve oversampling, the focal spot is moved between two successive views on the anode using electrostatic means. This is accomplished by arranging several electrodes in close proximity to the electron beam. The electrodes are energized to shape and deflect the electron beam as the beam leaves the cathode.

For good focal spot quality and repeatable results, the beam shaping and deflecting electrodes need to be manufactured to extremely tight tolerances and placed at consistent locations with respect to the electron beam. Changes in either the location of the electrodes or the dimensions of the electrodes requires individual X-ray tube testing, calibration and focal spot control adjustment for each X-ray system produced which is time consuming, costly and prevent drop-in replacement should the X-ray tube need replacing. At a system level, electrode placement must be consistent else each system would require specific calibration to compensate for variance in electrode placement.

Traditionally, the manufacturing method for producing multi-electrode cathode assemblies for X-ray tubes involved first machining the electrodes and then subsequent assembly of a complex cathode structure. Each individual electrode would be separately positioned in the cathode assembly and then bonded into place. This method of manufacture requires precise machining of a plurality of electrodes and then high accuracy in placing and bonding the several electrodes in their required location. The manufacture of such a multi-electrode system presents a formidable challenge because of the difficulty in placing and bonding the finished electrodes to tight manufacturing tolerances.

For the reasons stated above, and for other reasons stated below which will become apparent to those skilled in the art upon reading and understanding the present specification, there is a need in the art for a method of producing a multi-electrode cathode assembly wherein the beam shaping and deflecting electrodes can be accurately and repeatedly located with respect to the each other and to the cathode filament, in a less costly and less time consuming manner than the traditional method There is also a need for improved a multi-electrode cathode assembly which has beam shaping and deflecting electrodes located at precise and repeatable locations and which is also is less difficult to manufacture.

BRIEF DESCRIPTION OF THE INVENTION

The above-mentioned shortcomings, disadvantages and problems are addressed herein, which will be understood by reading and studying the following specification.

The methods and apparatus detailed below describe a multi-electrode cathode for an X-ray tube and methods for producing the same that greatly simplify manufacturing while providing tight manufacturing tolerances for electrode placement.

In one aspect, a monolithic metal block is bonded a to the nonconductive base and thereafter the block is machined to form at least one electrode.

In another aspect, a first face of a nonconductive base is pre-machined to form recesses. A monolithic metal block is then bonded to the first face of the nonconductive base. The monolithic metal block is thereafter machined to form electrodes of the required dimensions.

In yet another aspect, a first face of a nonconductive base is machined to form recesses. A monolithic metal block is then bonded to the first face of the nonconductive base. The monolithic metal block is thereafter machined to form electrodes of the required dimensions. A metal support base is bonded to a second face of the nonconductive base.

Apparatus, systems, and methods of varying scope are described herein. In addition to the aspects and advantages described in this summary, further aspects and advantages will become apparent by reference to the drawings and by reading the detailed description that follows.

BRIEF DESCRIPTION OF THE DRAWINGS

FIG. 1 is a flowchart of a method for producing a multi-electrode cathode for an X-ray tube according to an embodiment.

FIG. 2 is a flowchart of a method for producing a multi-electrode cathode for an X-ray tube according to an embodiment.

FIG. 3 is a flowchart of a method for producing a multi-electrode cathode for an X-ray tube according to an embodiment.

FIG. 4 is a perspective view of a pre-machined nonconductive base with recessed areas and raised pads.

FIG. 5 is a cross sectional view of a metal support base bonded to a pre-machined nonconductive based with a monolithic metal block bonded to the nonconductive base prior to electrode machining.

FIG. 6 is a cross sectional view of a multi-electrode cathode assembly according to an embodiment.

FIG. 7 is a perspective view of a multi-electrode cathode assembly according to an embodiment.

DETAILED DESCRIPTION OF THE INVENTION

In the following detailed description of embodiments of apparatus and methods for producing multi-electrode cathode for X-ray tubes, reference is made to the accompanying drawings that form a part hereof, and in which is shown by way of illustration specific embodiments in which the invention may be practiced. These embodiments are described in sufficient detail to enable those skilled in the art to practice the embodiments, and it is to be understood that other embodiments may be utilized and that logical, mechanical, electrical and other changes may be made without departing from the scope of the embodiments. The following detailed description is, therefore, not to be taken in a limiting sense.

FIG. 1 is a flowchart of a method for producing a multi-electrode cathode for an X-ray tube according to an embodiment. System 100 includes the actions of bonding 102 a monolithic metal block 504 to a nonconductive base 402, and thereafter machining 104 the monolithic metal block 504 to form electrodes 602, 606, 612 to the correct dimensional size at the required location according to the design requirements.

The nonconductive base 402 typically ceramic such as alumina or AlN, aluminum nitride, but other materials may be used as long as the material used can withstand the high temperature extremes encountered during operation of the device and the material's coefficient of thermal expansion (CTE) is matched to the CTE of the monolithic metal block 504 to prevent delamination at high temperature extremes. TZM, a molybdenum alloy, or Nb are good candidates with similar CTE's for the monolithic metal block 504 when a ceramic such as alumina or AlN is used for the nonconductive base 402 material.

Brazing is a common method of bonding ceramic materials to metals but other bonding methods may be also be utilized as long as the method is capable of providing sufficient adhesion between the nonconductive base 402 to the monolithic metal block 504 throughout the operating temperature range encountered during operation of the device. The method chosen must also be compatible with the materials used for the nonconductive base 402 and the monolithic metal block 504.

The monolithic metal block 504 may be machined to form electrodes using any high accuracy machining method such as wire Electro-Discharge Machining (EDM) or any other existing machining process such as conventional high accuracy milling as long as the method is suitable for the size and shape of the electrode desired. EDM is a preferred method for machining the electrodes when complex electrode structures are desired as it allows for complex electrode shapes. Traditional milling methods may be suitable for less complex designs.

Using the method described in FIG. 1, only a single monolithic metal block 504 needs to be handled during the electrode manufacturing process instead of a plurality of metal parts that form the cathode electrode assembly. By first bonding the monolithic metal block 504 to the nonconductive base 402 and then machining the electrodes 602, 606, 612 out of the monolithic metal block 504, high accuracy in electrode dimensioning and placement can be achieved.

System 100 solves the need in the art for a simpler, more efficient method of manufacturing a multi-electrode cathode assembly for focal spot control in X-ray tubes by reducing the number of pieces that need to be handled and mounted at precise locations with respect to the cathode filament. System 100 also reduces manufacturing time and costs associated with the difficult task of locating the electrodes for repeatability.

In other embodiments as shown in FIG. 2, an additional machining or forming action is added where the ceramic base is pre-machined to produce recesses in the nonconductive base 202. The nonconductive base 402 can be pre-machined to produce recesses 404 in the base to create raised pads the size and shape of which approximately match the footprints of the desired electrodes. The raised pads allow for complete electrical isolation between the electrodes 602, 606, 612 after the electrode machining operation 104 by providing a physical separation. The nonconductive base 402 can also be pre-machined to form a central opening 408 to provide clearance for the cathode filament. After pre-machining the nonconductive base 202, a monolithic metal block is bonded 102 to the nonconductive base 402, and then the monolithic metal block is machined to form the desired electrodes.

In other embodiments as shown in FIG. 3, a nonconductive base 402 is pre-machined by including a machining or forming action to produce recesses in the nonconductive base 202 to create raised isolation pads. A metal support base 502 is bonded 302 to the nonconductive base 402. The metal support base 502 aids the strength and stability of the structure. Bonding the nonconductive base 402 to the metal support base 502 can occur prior to the bonding of the monolithic metal block 504 or after the monolithic metal block has been machined to form electrodes. A monolithic metal block 504 is bonded 102 to the nonconductive base 402 and then the monolithic metal block 504 is machined 104 to form the desired electrodes 602, 606, 612.

While the method of producing a multi-electrode cathode is not limited to any particular number of electron emitters, a single filament multi-electrode cathode is described. The monolithic metal block can also be pre-machined prior to bonding to the nonconductive base to form a central opening for the cathode filament or for other features such as holes for the attachment of wires for the electrode.

Apparatus Embodiments

In the previous section, the particular methods of an embodiment are described by reference to a series of flowcharts. In this section, the particular apparatus of such an embodiment are described by reference to a series of diagrams.

FIG. 4 is a perspective view of a nonconductive base 402 that has been pre-machined to form recesses 404 in the body which create raised isolation pads 406. The nonconductive base may be alumina, AlN or other ceramic which should be chosen for its ability to withstand the high temperature extremes encountered at the X-ray tube cathode assembly during operation. The nonconductive base 402 may be pre-machined to form raised isolation pads that will provide complete isolation between the electrodes after the electrode machining operation 104. The nonconductive base can also be utilized with the additional machining action as long as complete isolation between the electrode is assured. The nonconductive base 402 can also be machined to provide a central opening for filament 608 placement in the completed cathode assembly.

FIG. 5 is a cross sectional view of a multi-electrode cathode assembly according to an embodiment prior to the final electrode machining action 104. A monolithic metal block 504 is bonded to a first face of pre-machined nonconductive base 402. The bonding 102 of the monolithic metal block 504 to the nonconductive base 402 is an easy task as the mounting position is not critical. Subsequent machining actions 104 to form electrodes 602, 606, 612 will be used to locate and dimension the electrodes to critical tolerances as specified by the design. A metal support base 501 is bonded to a second face of the pre-machined nonconductive base 402 but this action may also be performed at any time during the cathode manufacturing process.

FIGS. 6 and 7 show a cross sectional view and a perspective view of a multi-electrode cathode assembly according to an embodiment. A pre-machined nonconductive base 402 is bonded to a metal support base 502 supporting a filament assembly 610 comprising a filament 608. The pre-machined nonconductive base 402 has been machined to leave recesses 404 in the body of the nonconductive base 402. The recesses 404 create raised isolation pads 406 which provide complete isolation between the electrodes after the electrode machining operation 104.

The electrode machining operation can be performed using wire Electro-Discharge-Machining or any other high accuracy milling method. Focus electrode 606 and length electrode 612 are formed during this action. Deflector electrodes 602 may also be formed during this final machining action by making an appropriate cut 604 to isolate the deflector from the focus electrode 606. As precision machining is a relatively easy task to perform by one skilled in the art, the multi-electrode cathode apparatus can be made to extremely tight tolerances using a greatly simplified manufacturing method.

During operation of the multi-electrode cathode assembly, the cathode filament 608 is energized using a current source. The filament heats up and electrons are boiled off. An anode assembly on the opposite side of the X-ray tube is positively charged creating a large voltage differential that accelerates the electrons across the X-ray tube. When focus spot control is desired, the deflector electrode 602 are biased with a negative voltage up to several kV relative to the filament reference potential by means of wires 614 brazed to the back of the metal block to change the focal spot size and to electrostaticly deflect the beam to a desired position along one axis. The focus electrodes 606 and the length electrodes 612 are positioned close to the filament but 90 degrees apart from each other and are energized to change the size of the electron beam and can be used to steer the electron beam as it leaves the cathode.

CONCLUSION

A multi-electrode cathode assembly apparatus and method for producing a multi-electrode cathode assembly is described. Although specific embodiments are illustrated and described herein, it will be appreciated by those of ordinary skill in the art that any arrangement which is calculated to achieve the same purpose may be substituted for the specific embodiments shown. This application is intended to cover any adaptations or variations.

In particular, one of skill in the art will readily appreciate that the names of the methods and apparatus are not intended to limit embodiments. Furthermore, additional methods and apparatus can be added to the components, functions can be rearranged among the components, and new components to correspond to future enhancements and physical devices used in embodiments can be introduced without departing from the scope of embodiments. One of skill in the art will readily recognize that embodiments are applicable to future devices.

The terminology used in this application is meant to include all environments and alternate technologies which provide the same functionality as described herein

I claim:

1. A method of manufacturing a multi-electrode cathode assembly for an X-ray tube, the method comprising:

machining a first face of a nonconductive base to form recesses, wherein the nonconductive base further comprises ceramic;

bonding a monolithic metal block to the first face of the nonconductive base; and thereafter machining the monolithic metal block to form at least one electrode of the multi-electrode cathode assembly for an X-ray tube.

2. The method of claim 1, wherein the action of bonding the monolithic metal block to the nonconductive base further comprises:

brazing.

3. The method of claim 1, wherein the nonconductive ceramic base further comprises:

alumina.

4. The method of claim 1, wherein the machining action further comprises:

Electro-Discharge-Machining.

5. The method of claim 1, wherein the machining action further comprises milling.

6. The method of claim 1, wherein the nonconductive ceramic base further comprises:

alumina.

7. The method of claim 1, wherein the monolithic metal block further comprises:

niobium.

8. The method of claim 1, wherein the monolithic metal block further comprises:

a molybdenum alloy.

9. The method of claim 1, wherein the monolithic metal block further comprises:

a molybdenum alloy.

10. The method of claim 1, wherein the material of the nonconductive base and the material of the monolithic metal block are selected to have matching coefficients of thermal expansion to prevent delamination at high temperature extremes.

11. A method of manufacturing a multi-electrode cathode assembly for an X-ray tube, the method comprising:

bonding a monolithic metal block to the first face of the nonconductive base;

thereafter machining the monolithic block to form at least one electrode of the multi-electrode cathode assembly for an X-ray tube; and bonding a metal support base to a second face of the nonconductive base.

12. The method of claim 11 wherein the first face of the nonconductive base further comprises:

a pre-machined first face that forms recesses prior to the bonding of the monolithic metal block.

13. The method of claim 11, wherein the action of bonding the monolithic metal block to the nonconductive base further comprises:

brazing.

14. The method of claim 11, wherein the nonconductive base further comprises:

ceramic.

15. The method of claim 11, wherein the machining action further comprises:

Electro-Discharge-Machining.

16. The method of claim 11, wherein the machining action further comprises:

milling.

17. The method of claim 11, wherein the monolithic metal block further comprises:

a molybdenum alloy.

18. The method of claim 17, wherein the molybdenum alloy further comprises:

titanium zirconium molybdenum.

19. The method of claim 11, wherein the nonconductive ceramic base further comprises:

alumina.

20. The method of claim 11, wherein the monolithic metal block further comprises:

niobium.

* * * * *